US007137795B2

(12) United States Patent
Kamal et al.

(10) Patent No.: US 7,137,795 B2
(45) Date of Patent: Nov. 21, 2006

(54) STATOR FOR ECCENTRIC SPIRAL PUMP

(75) Inventors: Hisham Kamal, Waldkralburg (DE); Michael Robby, Mühldorf (DE)

(73) Assignee: Netzsch-Mohnopumpen GmbH, Selb (DE)

( * ) Notice: Subject to any disclaimer, the term of this patent is extended or adjusted under 35 U.S.C. 154(b) by 0 days.

(21) Appl. No.: 11/074,862

(22) Filed: Mar. 8, 2005

(65) Prior Publication Data

US 2005/0147516 A1 Jul. 7, 2005

Related U.S. Application Data

(63) Continuation of application No. PCT/DE03/002726, filed on Aug. 13, 2003.

(30) Foreign Application Priority Data

Sep. 10, 2002 (DE) ..... 102 41 753

(51) Int. Cl.
*F03C 2/00* (2006.01)
*F03C 18/00* (2006.01)

(52) U.S. Cl. ..... 418/48; 418/108; 418/153

(58) Field of Classification Search ..... 418/48, 418/108, 152, 153, 156
See application file for complete search history.

(56) References Cited

U.S. PATENT DOCUMENTS

| | | | | | |
|---|---|---|---|---|---|
| 3,084,631 | A * | 4/1963 | Bourke | ..... | 418/48 |
| 3,435,772 | A * | 4/1969 | Schlecht | ..... | 418/48 |
| 3,857,654 | A * | 12/1974 | Streicher | ..... | 418/48 |
| 4,313,717 | A | 2/1982 | Kopecky | | |
| 5,474,432 | A * | 12/1995 | Hulley et al. | ..... | 418/48 |

FOREIGN PATENT DOCUMENTS

| | | | | | |
|---|---|---|---|---|---|
| DE | 2043609 | A1 * | 3/1972 | ..... | 418/48 |
| DE | 2 202 763 | | 7/1973 | | |
| DE | 2 243 479 | | 3/1974 | | |
| DE | 33 12 197 | | 10/1984 | | |
| DE | 86 32 827 | | 9/1989 | | |
| DE | 3908193 | A * | 5/1990 | | |
| DE | 100 42 335 | | 3/2002 | | |
| EP | 0 612 922 | | 8/1994 | | |
| FR | 1258107 | A1 * | 2/1961 | ..... | 418/48 |
| GB | 799 996 | * | 8/1958 | ..... | 418/48 |

OTHER PUBLICATIONS

International Search Report, PCT/DE03/02726, mailed Dec. 10, 2003.

* cited by examiner

*Primary Examiner*—Theresa Trieu
(74) *Attorney, Agent, or Firm*—Kevin L. Daffer; Daffer McDaniel, LLP

(57) ABSTRACT

A stator for an eccentric spiral pump comprises a hollow body of an elastic material which has a casing comprising a plurality of segments extending in a longitudinal direction of the casing. Adjacent segments are interconnected along longitudinal sides at variable angles to each other, so that the segments enclose an entire circumference of the casing. Surfaces of the segments are of a planar configuration, so that a closed casing of polygonal cross-section is formed by the interconnected segments. The hollow body of elastic material is of a matching polygonal cross-section to achieve positive contact with the casing.

24 Claims, 11 Drawing Sheets

STATOR FOR ECCENTRIC SPIRAL PUMP

CROSS REFERENCE TO RELATED APPLICATIONS

This application is a continuation of pending International Application No. PCT/DE03/002726 filed Aug. 13, 2003, which designates the United States and claims priority from pending German Application No. 102 41 753.9 filed Sep. 10, 2002.

BACKGROUND OF THE INVENTION

1. Field of the Invention

The invention relates to a stator for an eccentric spiral pump or eccentric screw pump with a helical rotor. The stator also has a helical cavity to receive the rotor and consists mainly of an elastic material which is surrounded by a rigid casing.

2. Description of the Prior Art

In rotors corresponding to the prior art either a solid or a rigid casing composed of a plurality of segments is used to accommodate the elastic material of the rotor.

Thus, U.S. Pat. No. 4,313,717 discloses a rotor housing consisting of three identically axially arranged housing segments which are clamped together by means of a band. In this housing three housing segments matched to the circumference of the rotor, as well as the corresponding clamping means to clamp the rotor housing around the rotor itself are thus necessary. Without these clamping means the housing segments cannot be held on the rotor.

Known from DE 33 12 197 C2 is an eccentric spiral pump with a casing which has segments interconnected by positive contact. In this case, the edges of neighboring segments are arranged such that they intermesh in a tongue and groove fashion. These tongue-and-groove fixings have contact surfaces so that they are not movable towards one another. Furthermore, these fixings are provided exclusively at the ends of the segments whereas along the remaining outer surfaces there is even a distance between the segments in order to make it possible to adjust the diameter for matching according to the rotor wear. For this purpose additional clamping means are required however.

These rotors of eccentric spiral pumps according to the prior art have the disadvantage that for each size, i.e. for each diameter of a rotor, a special casing matched to this diameter must be provided. Thus, for each type of pump, construction costs, tool costs and manufacturing costs are incurred anew. In addition, with a broad production program there is a high expenditure in warehousing for different types of pumps.

BRIEF SUMMARY OF THE INVENTION

The object of the invention is to shape the stator of an eccentric spiral pump such that a cheap and simplified structure is possible.

In accordance with the invention this object is achieved by a stator for an eccentric spiral pump, comprising: a hollow body of an elastic material, the hollow body extending in a longitudinal direction and having a helical cavity formed therein for receiving a rotor; and a casing provided on an outside of the hollow body, the casing comprising a plurality of segments having a length extending in the longitudinal direction, adjacent segments being interconnected at angles to each other along longitudinal sides, so that the segments enclose an entire circumference of the hollow body; wherein adjacent segments are linked to each other at variable angles to form a tension-loadable positive connection.

In accordance with the invention, the above object is also achieved by a hollow body of a stator for eccentric spiral pumps, the hollow body being made of elastic material and having a helical cavity for receiving a rotor, wherein the outside of the hollow body has a polygon-shaped cross-section.

BRIEF DESCRIPTION OF THE DRAWINGS

The invention is explained below using exemplary embodiments with reference to the drawings without restricting the general inventive idea.

DETAILED DESCRIPTION OF THE INVENTION

Figure 1:
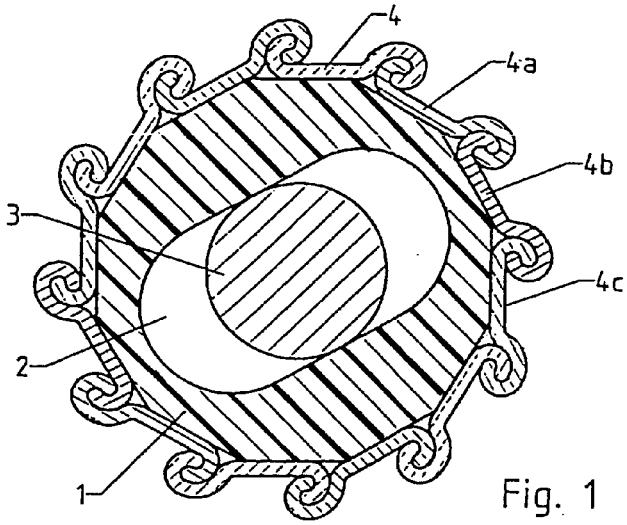
FIG. 1 is a schematic diagram of the device according to the invention in general form.

FIG. 1 shows a sectional view of a device according to the invention. A stator for eccentric spiral pumps has a hollow body 1 made of preferably elastic material. Accommodated in a helical cavity 2 is a likewise helical rotor 3. The outer profile of the hollow body 1 made of elastic material has a polygon-shaped cross-section. The casing enclosing the hollow body consists of a plurality of segments 4*a*, 4*b*, 4*c* which extend in the longitudinal direction (axial) of the hollow body. The segments are interconnected in a form-locked fashion. The connection is also tensile-loadable and thus limits the expansion of the circumference of the hollow body.

Figure 2:
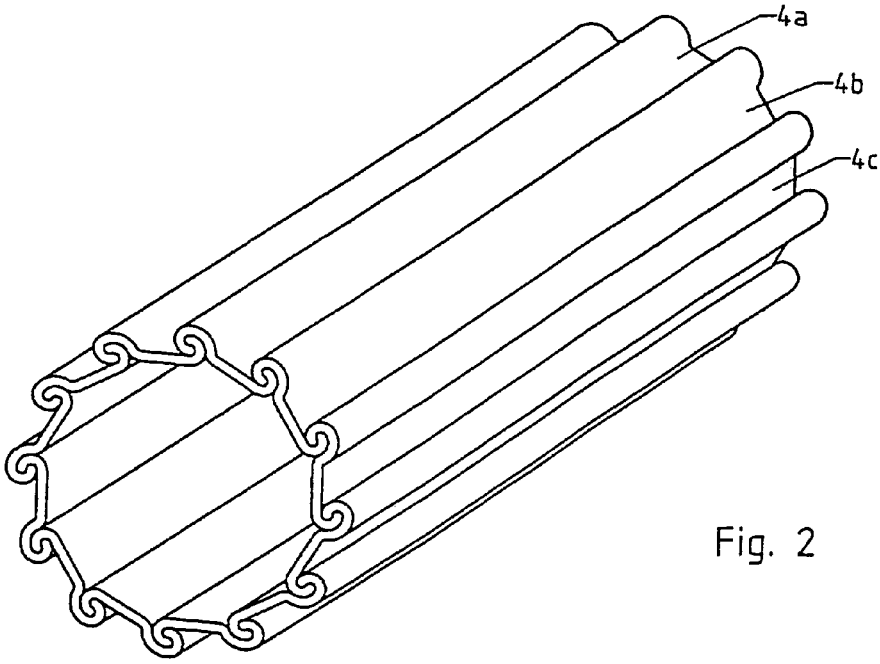
FIG. 2 is a perspective view of a casing according to the invention.

FIG. 2 shows a perspective view of a casing according to the invention. In this example, this casing consists of 12 segments of which three are denoted for example by 4*a*, 4*b*, 4*c*. Naturally, designs with different numbers of segments, such as for example, 10 segments or 14 segments can also be achieved. In any case, at least three segments are required to enclose a cavity. The upper limit for the number of segments is set by the economic efficiency of the assembly. A casing with an extremely large number of segments can be assembled only at high cost, unless it is implemented in the form of a chain as described subsequently.

Figure 3:
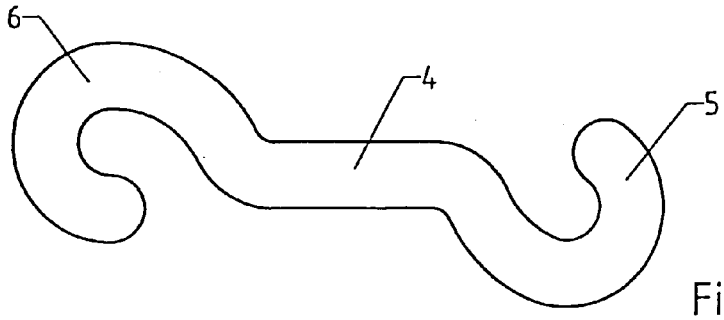
FIG. 3 shows an individual segment.

FIG. 3 finally shows a sectional view of a single segment 4. In this case, the individual segments are interconnected by a first connecting element 5 which is in engagement with a second connecting element 6 of another segment. As a result of the special arrangement proposed here, the segments are movable towards each another within a certain angular range.

Figure 4:
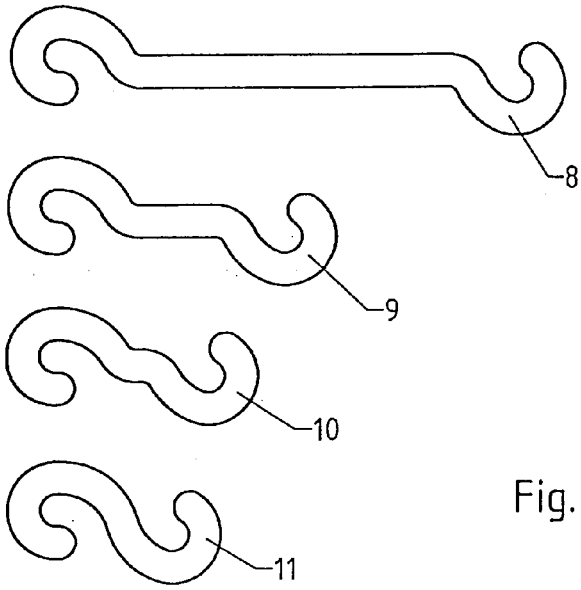
FIG. 4 shows segments of different length.

As an example, FIG. 4 shows segments of different width from which casings of different diameter can be produced by combination. These are hereinafter designated as type 1 (11), type 2 (10), type 3 (9) and type 4 (8). Naturally, arbitrary dimensions of segments are the subject matter of the invention.

Figure 5:
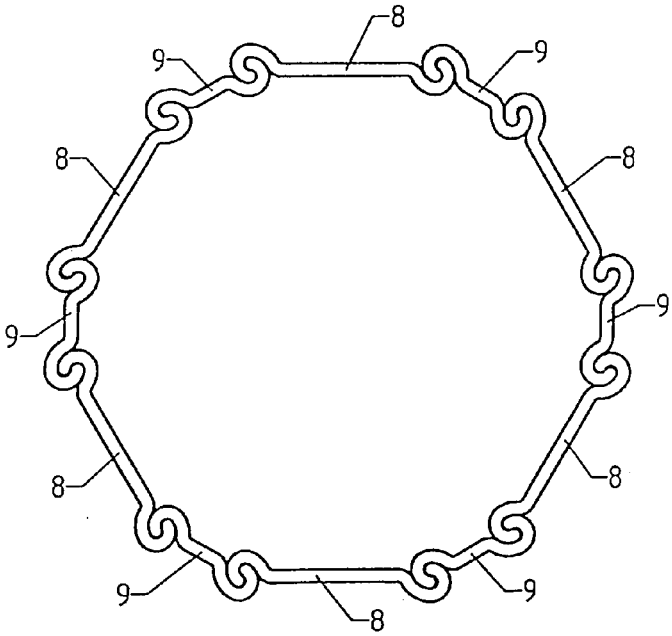
FIGS. 5 to 7 show different combinations of segments.

FIG. 5 shows a combination of six respective segments of type 4 (8) and of type 3 (9), wherein the segments of different types are combined alternately with each another.

Figure 6:
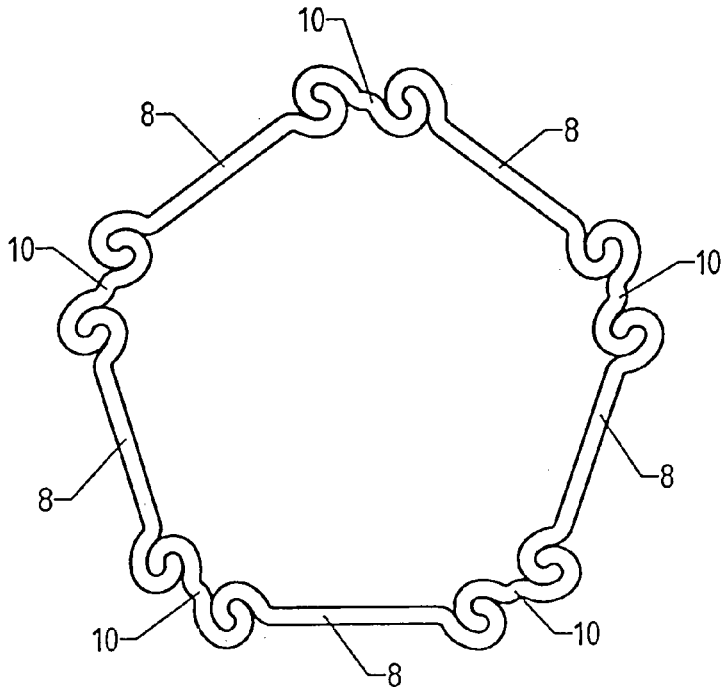

FIG. 6 shows a further combination of different segments. In this case, five respective segments of type 4 (8) and of type 2 (10) are combined alternately with each another. As a result, a different shape of the outer contour and a different diameter are obtained compared with the arrangement shown in FIG. 5.

Figure 7:
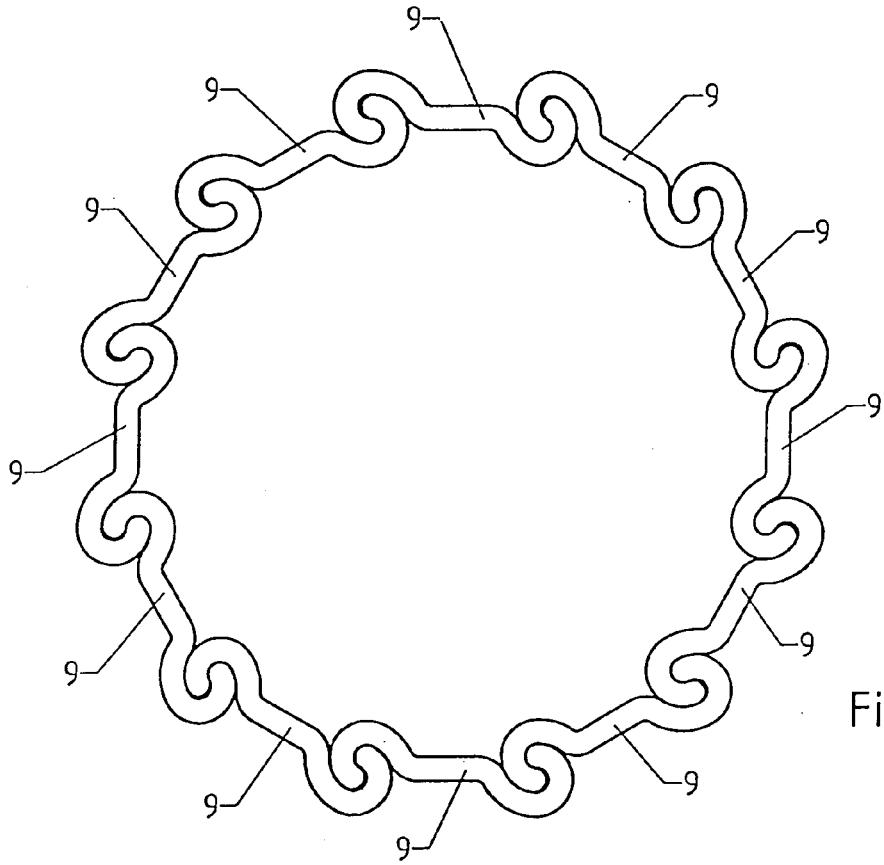

FIG. 7 shows a combination of 12 segments of the same kind of type 3 (9). The representations of the various combinations of segments in the various Figures are not to scale.

Figure 8:
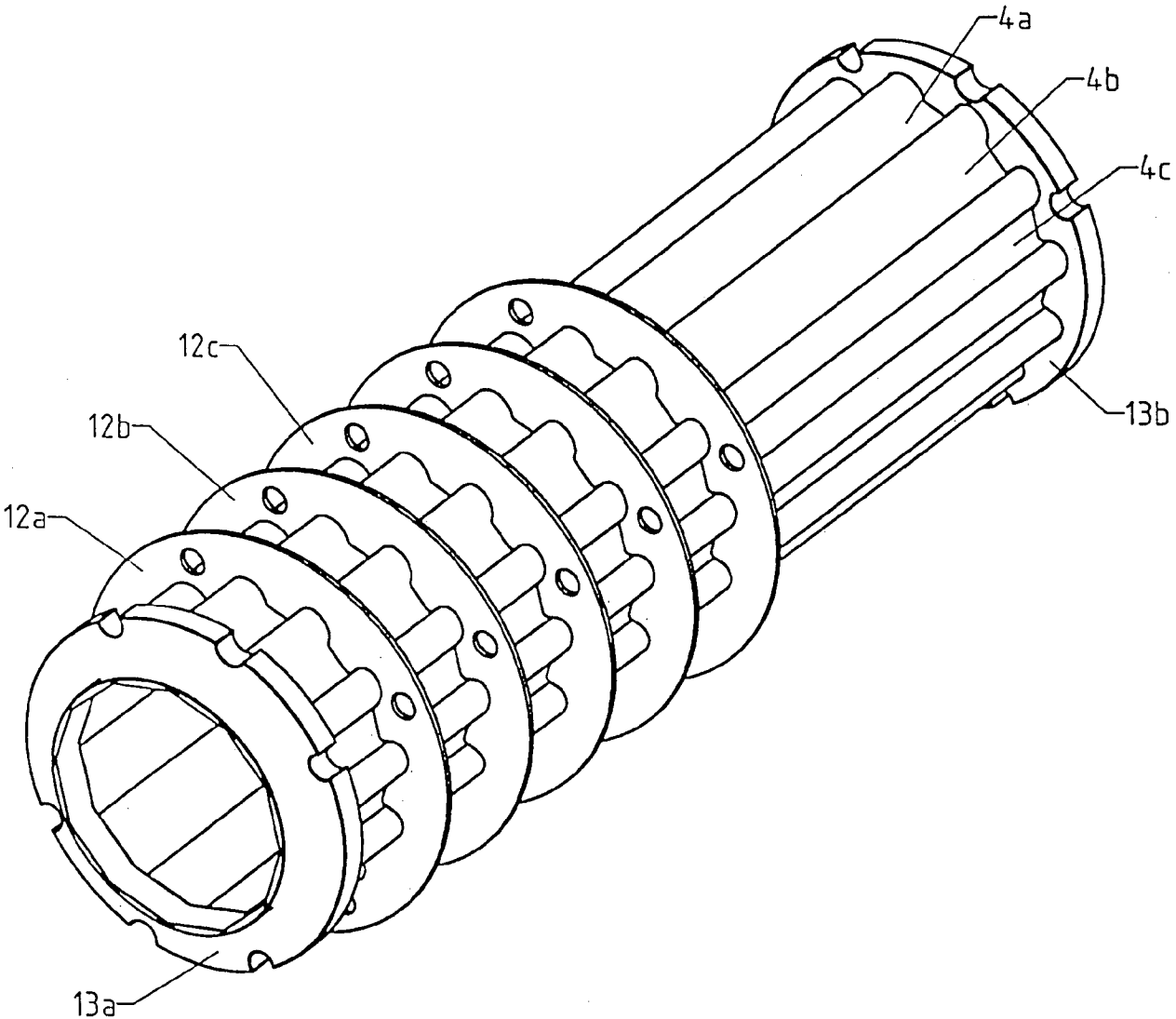
FIG. 8 shows segments with support rings.

FIG. 8 shows an arrangement in which additional support rings 12*a*, 12*b*, 12*c* are preferably attached to accommodate higher pressures. Such support rings preferably extend along the circumference and may themselves be provided with fixing means such as holes, on the one hand for fixing to the segments, and on the other hand for fixing the support rings themselves or fixing the entire device. Furthermore shown are end rings 13*a*, 13*b* which additionally support the segments at their ends. The support here can preferably be in the longitudinal direction but also radial, as in the case of the support rings described previously.

Figure 9:
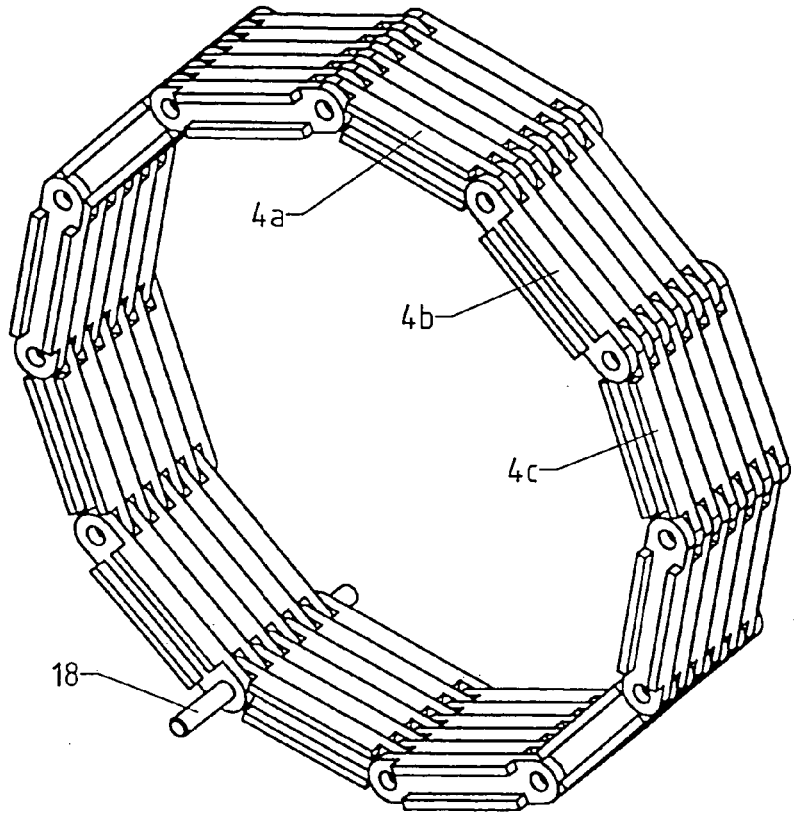
FIGS. 9 to 19 show an arrangement with short elements.

FIG. 9 shows another advantageous embodiment of the invention in which the individual segments 4*a*, 4*b*, 4*c* are interconnected in the form of a chain. For this purpose, the segments have holes at their ends through which fixing elements such as bolts 18, rivets or others can be inserted.

Figure 10:
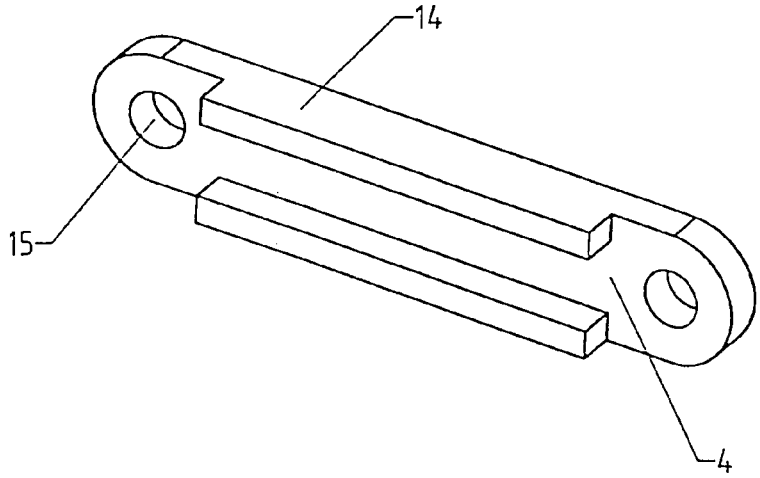

FIG. 10 shows a single segment 4 from an arrangement in accordance with FIG. 9. In the enlarged view the holes 15 and the contact surfaces 14 can be identified. The contact surfaces are used to support the hollow body provided that they are assigned to the inside of the chain facing the hollow body made of elastic material. It is thus possible to support the chain over a large area and therefore achieve problem-free introduction of forces into the hollow body. A corresponding almost closed inner surface can be seen in FIG. 9.

Figure 11:
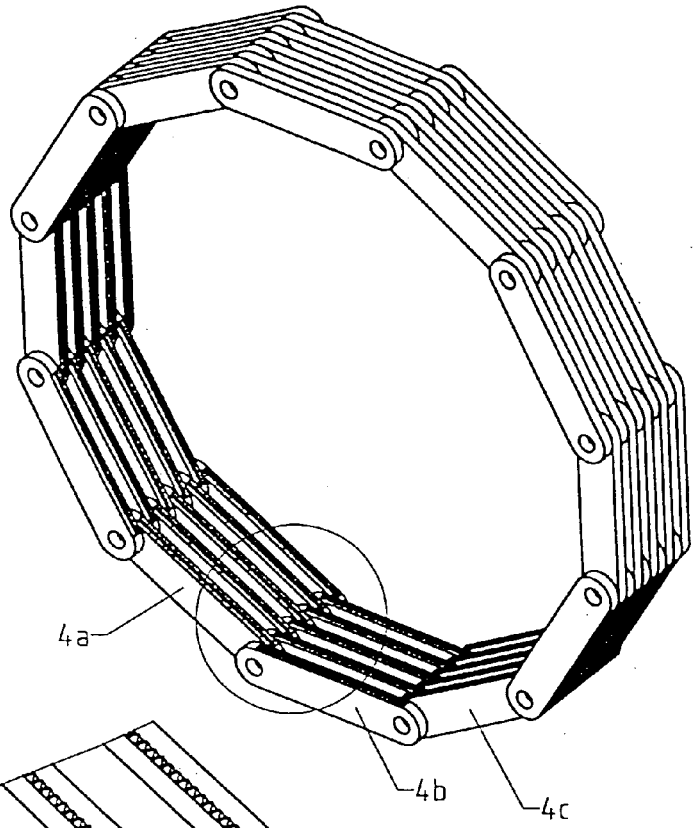
Figure 11A:
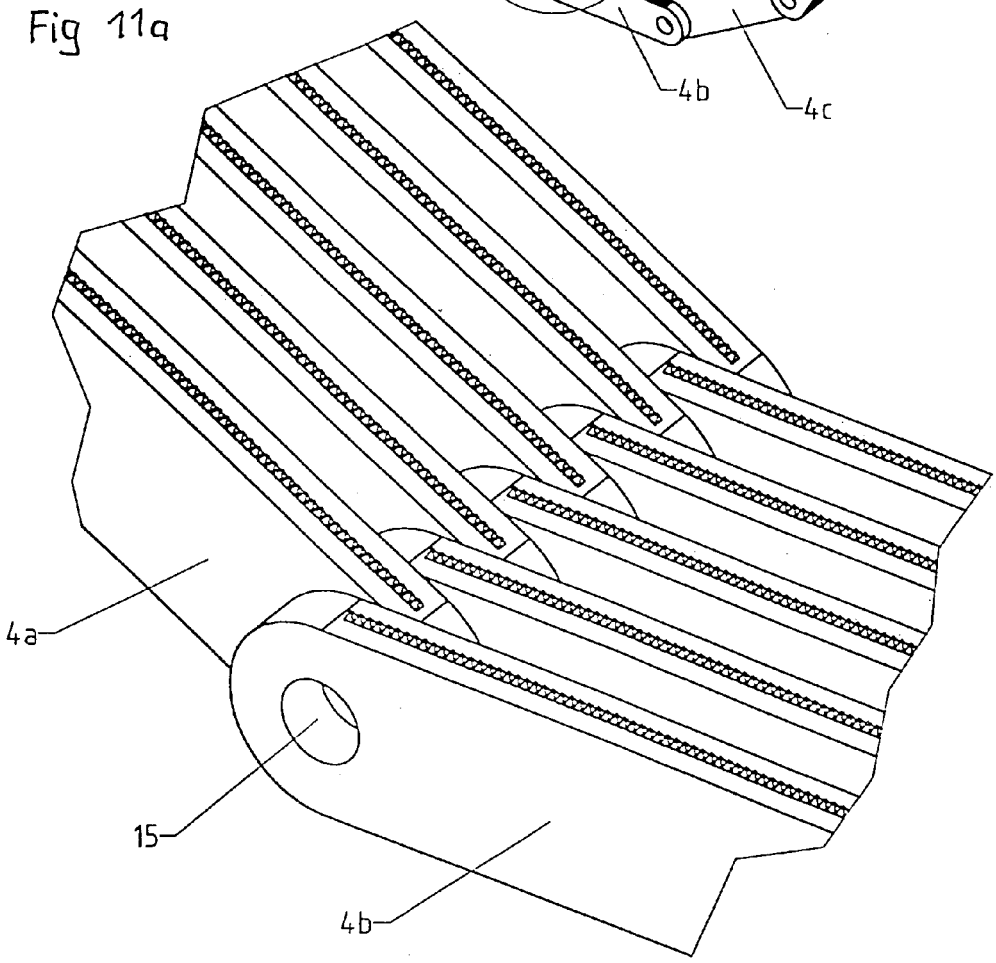

FIG. 11 shows another chain-shaped arrangement of the individual segments 4*a*, 4*b*, 4*c*. In the enlarged section the interaction of the individual chain members can be clearly identified. The connection of the individual segments to form a chain is again made using holes and the fixing elements, not shown here, which are retained in these holes.

Figure 12:
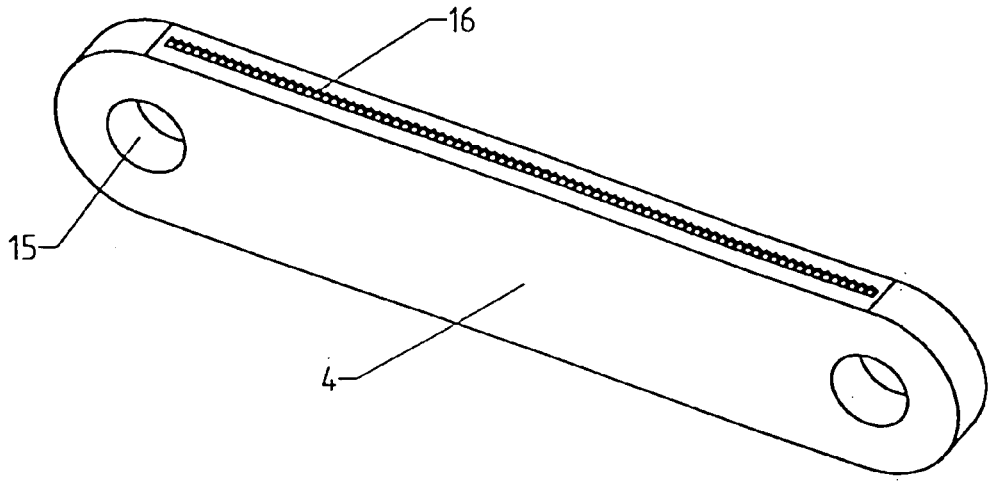

FIG. 12 shows a single segment 4 of the chain-shaped arrangement from FIG. 11. The hole 15 is used to connect a plurality of segments. The retaining teeth 16 are used to increase the friction between the segments and the hollow body made of elastic material.

Figure 13:
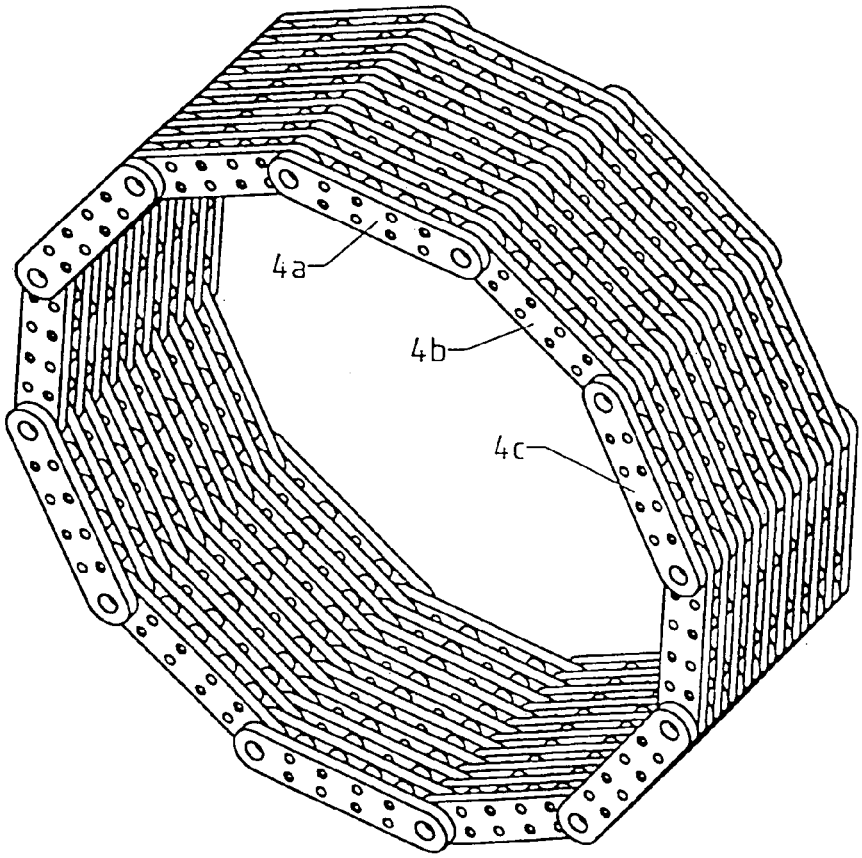

FIG. 13 shows another chain-shaped arrangement of individual segments 4*a*, 4*b*, 4*c* wherein the segments are interconnected by additional connecting elements as well as by bolts.

Figure 14:
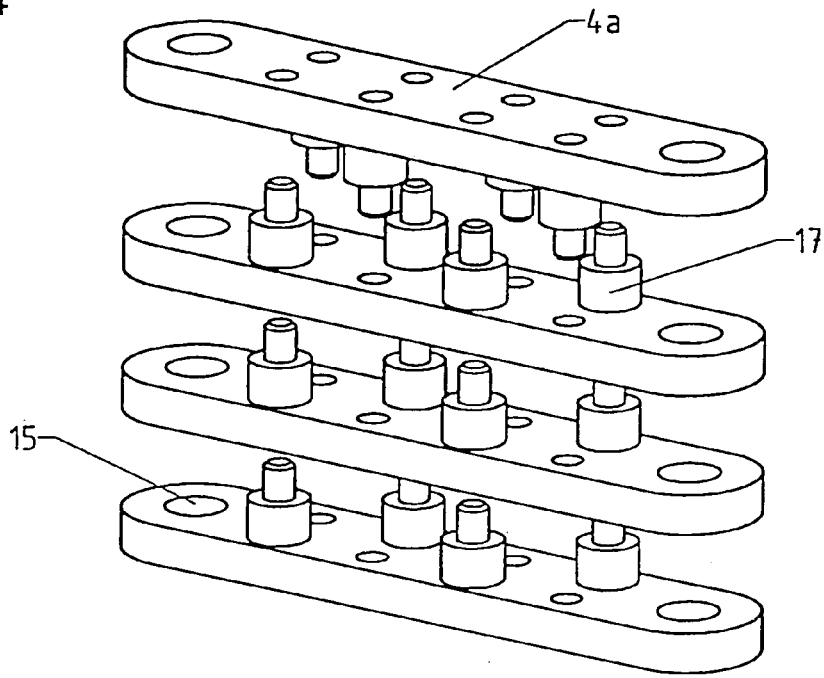

FIG. 14 shows a detailed view of individual segments with connecting elements 17 which at the same time produce a defined spacing between segments. Depending on the design, the connecting elements can fix the individual segments to each other along arbitrary axes. Thus, for example, a lateral fixing or a fixing along the longitudinal direction of the stator is possible.

Figure 15:
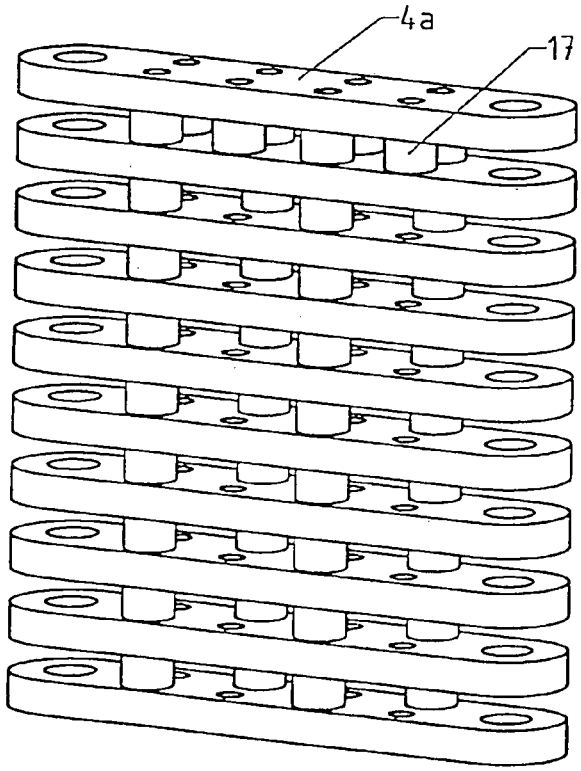

FIG. 15 shows a detailed view of the ready-mounted segments with associated connecting elements. A relatively rigid composite system is obtained through this arrangement of the segments. Thus, the total stiffness of the casing is increased substantially. This is especially advantageous at high pressures.

Figure 16:
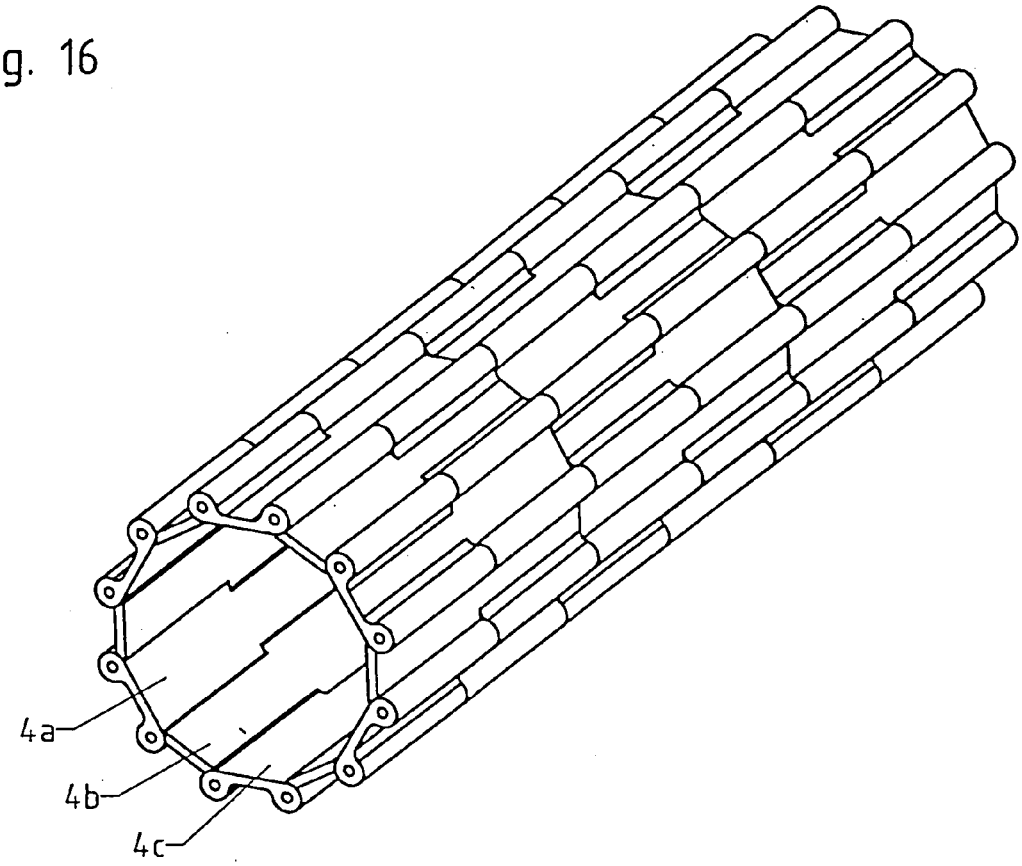

FIG. 16 shows a chain-shaped arrangement in which the individual segments have especially large contact surfaces. As a result, an almost closed inner surface is obtained.

Figure 17:
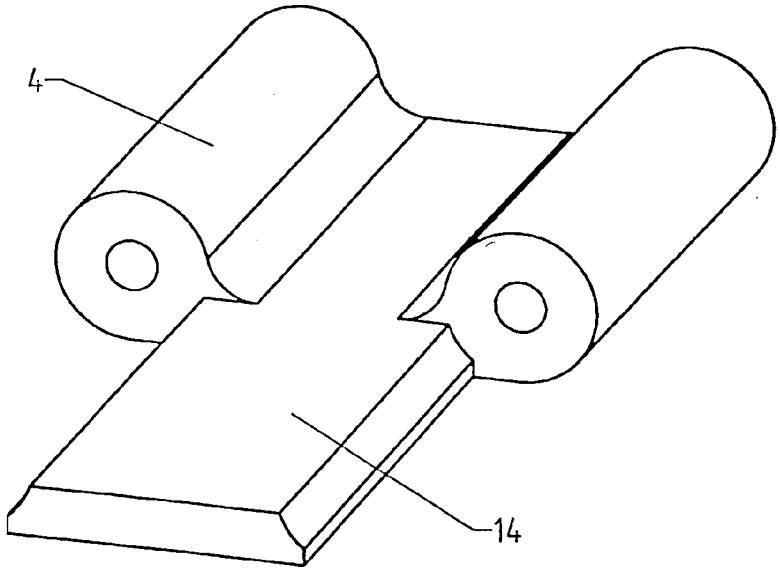

FIG. 17 shows an individual segment of the arrangement of FIG. 16. The enlarged contact surface 14 can be seen especially clearly here.

Figure 18:
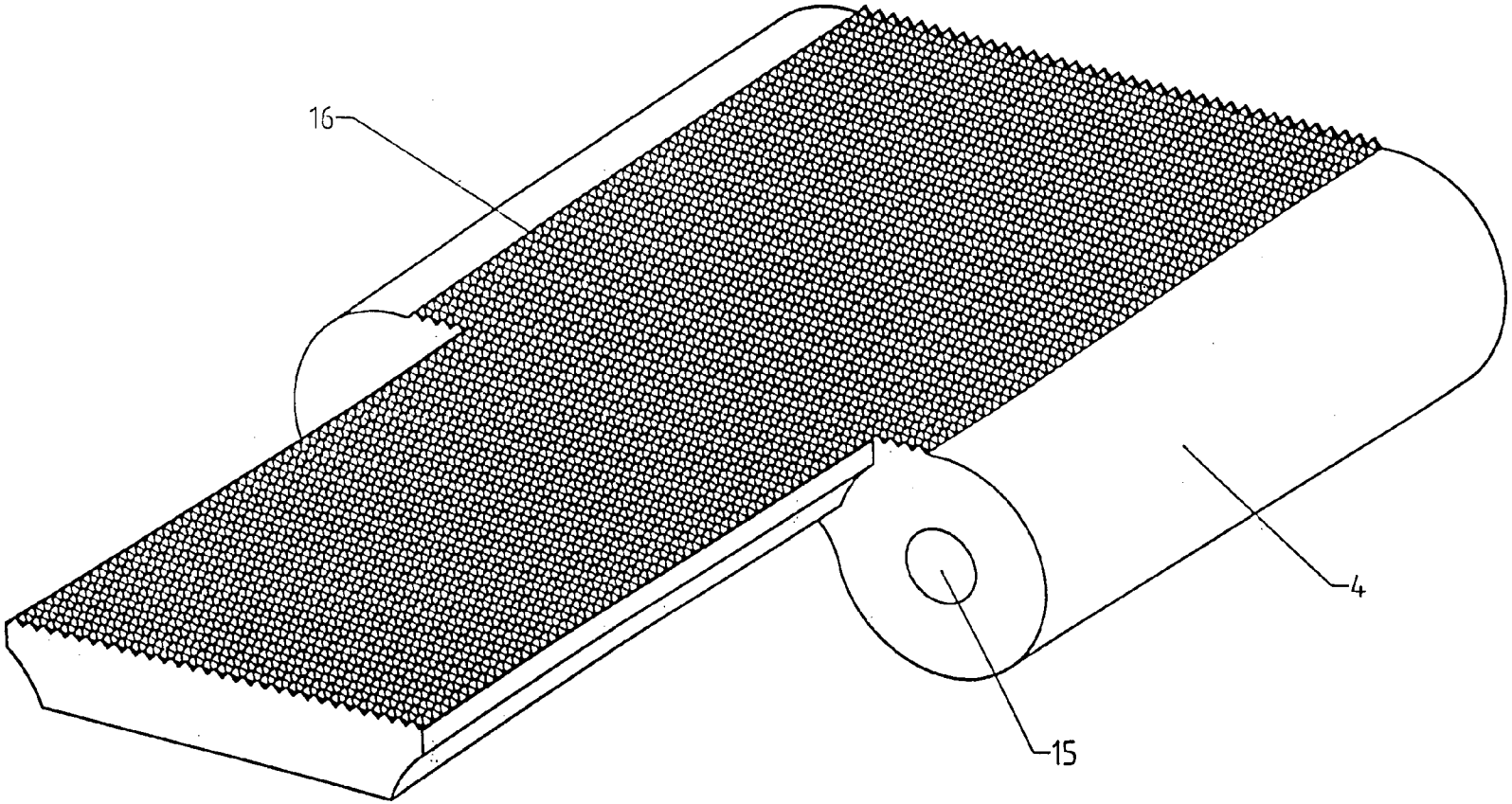

FIG. 18 shows another embodiment of the segments of the arrangement of FIG. 16. In this case, the contact surface has additional retaining teeth 16.

Figure 19:
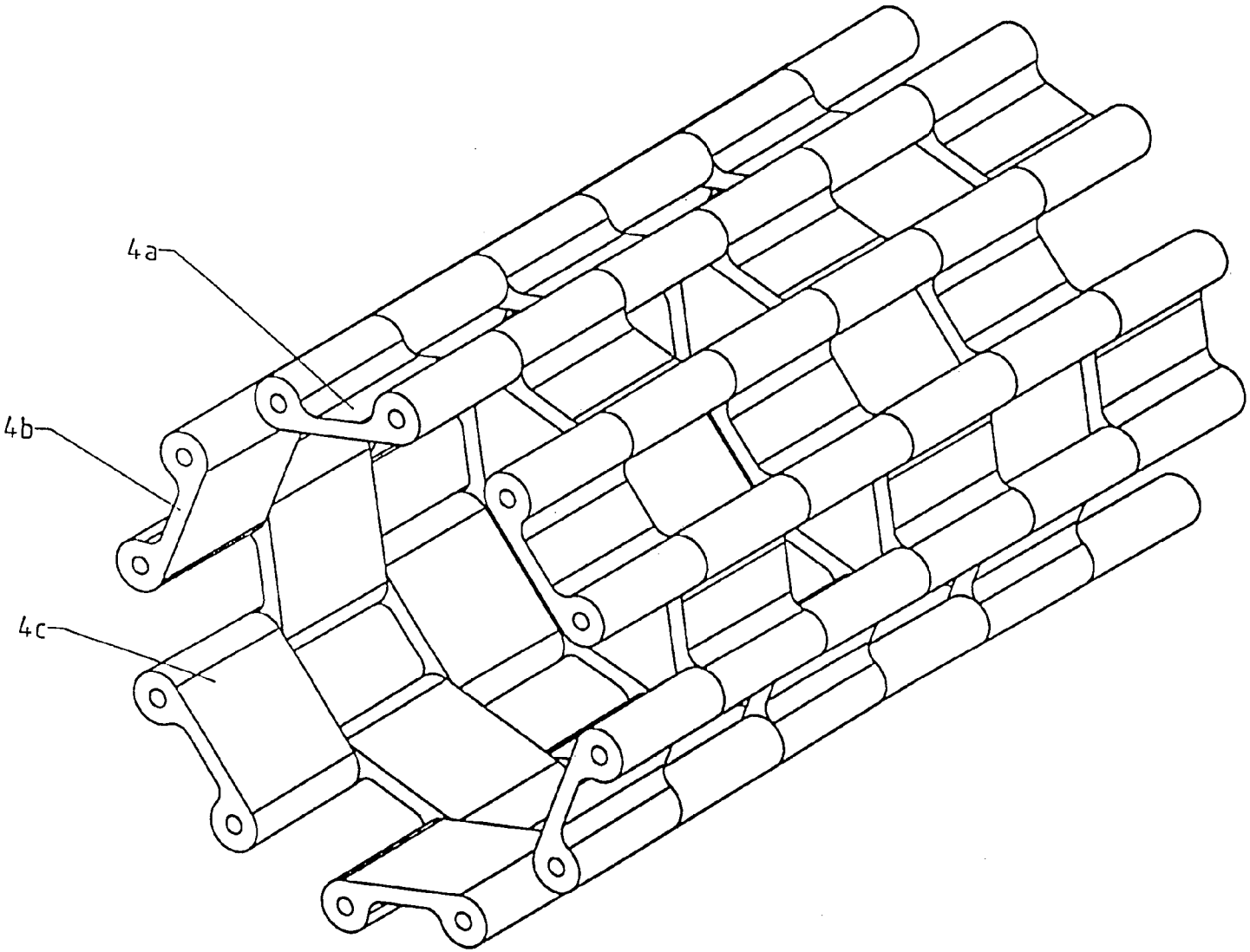

FIG. 19 shows another chain-shaped arrangement with gaps between the segments arranged in a chain shape.

The stator for eccentric spiral pumps according to the invention comprises a hollow body made of elastic material which is enclosed by a casing of segments.

The longitudinal sides of at least a plurality, but preferably of all the segments, are constructed such that neighboring segments are connected to each another along the circumference at variable angles or movably in order to produce a tensile-loadable positive connection. In a typical case such an angular range is about 10°. As a result of this arrangement of the connection, different numbers of elements can be combined with different diameters of the casings. Thus, for example, 10, 11, 12, 13 or even 14 segments can be combined to form a casing with diameters each corresponding to the number of segments. In the same way, segments of different width can be combined with each other. Thus, numerous different diameters of the casing can be achieved with a few (for example, two) different profiles by corresponding combinations and different numbers. The specification of the length of a segment always relates to its extension along the longitudinal direction of the stator.

Furthermore, in a particularly advantageous embodiment of the invention, the individual segments are arranged such that their surfaces lie predominantly in one plane. Thus, as a result of the connection of a plurality of segments, a closed casing in polygon shape is obtained. This polygon shape now engages in a corresponding polygon shape of the outside of the hollow body made of elastic material so that a positive contact is obtained for transmission of the torque.

The segments themselves can be made of numerous different materials. Especially suitable are metal, ceramic, elastomer or thermoplastic materials. Similarly, the segments can consist of combinations of different materials. Thus, for example, a combination of a metal longitudinal edge and an elastomer arranged between the longitudinal sides can be used to compensate for tolerances.

In another advantageous embodiment of the invention the connection between the individual segments is arranged in a tongue-and-groove fashion. However, it is important for a design in accordance with the invention that the segments connected in this fashion can move with respect to each other.

In a further advantageous embodiment of the invention the connection of the segments with each another is designed so that these can be pushed into engagement with each other along the longitudinal direction. Thus, the complete unit can be assembled particularly favourably by simply pushing together the segments.

Another embodiment of the invention provides that the segments have holes running in the longitudinal direction.

Furthermore, the longitudinal sides of segments can be interconnected in the longitudinal direction by additional fixing elements such as, for example, bolts, pins, rods or even rivets.

In a further advantageous embodiment of the invention, the longitudinal sides of the segments have circular intermeshing profiles or shapes. As a result of this circular arrangement, mobility can be achieved particularly simply in a large angular range.

Another embodiment of the invention provides that the longitudinal sides of the segments have angular profiles such as, for example, polyhedral or swallow-tail profiles. In order to ensure sufficient movability, suitable spacings should be provided here.

Another embodiment of the invention provides that the length of the individual segments is shorter than the length of the hollow body. Thus, at least two segments can be arranged one after the other along the longitudinal direction of the hollow body.

Furthermore, at least two successive segments in the longitudinal direction can advantageously be laterally offset from each another, i.e., along the direction of the circumference of the hollow body. The offset preferably corresponds to the width of a single segment.

In a particularly advantageous embodiment at least two segments are interconnected in the form of chain members. A particularly simple and cheap form of the arrangement is obtained if all the segments are interconnected to form a large chain. Thus, especially in the case of a large number of small chain members, it is possible to conform to the desired length of the hollow body, or the circumference of the hollow body, optionally along the longitudinal direction, or along the direction of the circumference, in small steps.

Advantageously at least a plurality of segments in the form of chain members are provided with spacers or integrated connecting elements. As a result, in a first pre-assembly step a plurality of such segments can be combined to form a composite system. Such pre-assembly is easily possible using an automatic assembly machine. For the final assembly only a few rows of chain members then need to be interconnected around the hollow body, for example by means of connecting bolts. With a suitable arrangement of the connecting elements, the last chain member in a row can be mounted in a configuration rotated by 180 degrees so that the row of chain members is terminated flush.

In a further advantageous embodiment of the invention means are provided to limit the angular range of the movement of the segments with respect to each other. As a result, the movability of the assembled polygon can be limited in order to simplify the assembly, prevent the segments from jamming together, or increase the stiffness of the casing.

In a further advantageous embodiment of the invention an additional force-locked connection of the longitudinal sides of the segments is provided. Such a connection can for example be a welded connection or an adhesive connection. Such a connection is appropriately made only after the individual segments have been pushed together. Thus, by means of the force-locking connection, the individual segments can be fixed together at a predetermined angle suited to the final configuration.

In another embodiment of the invention an additional force-locking connection is provided between at least one, preferably a plurality of segments and the hollow body made of elastic material. Such a connection can be made, for example, by vulcanising or adhering.

Another embodiment of the invention provides that at least one segment has a surface with particularly high roughness, or additional retaining teeth, or a corrugation. This particular surface of the segment faces the hollow body. Owing to the rough surface, the friction between the segments and the hollow body can be substantially increased, whereby twisting/turning of the hollow body during the rotation of the rotor is avoided.

In a further advantageous embodiment of the invention at least one segment has at least one additional contact surface for supporting the hollow body. Thus, the contact surface of the hollow body on the segments i.e., the area of force exertion between the hollow body and the segments, can be enlarged. This results in a higher stability and a smaller deformation of the hollow body.

In a further advantageous embodiment of the invention the hollow body of elastic material is shaped so that it overlaps the segments at the end faces. As a result, the segments are sealed by the elastic material of the hollow body.

A further embodiment of the invention provides that at least some segments consist of a mechanically stiff material which has a substantially higher stiffness than that of the hollow body of elastic material.

In a further advantageous embodiment of the invention, at least some of the segments have an elastic material.

A further embodiment of the invention consists in that at least one tensioning means is provided with which the diameter of the casing consisting of segments can be fixed or adjusted. It is thereby possible to adapt the diameter with increasing wear of the hollow body of elastic material.

Another embodiment of the invention provides additional support rings which support the segments from the outside. As a result, even with high pressures in the hollow body, the individual segments cannot be outwardly deformed. The equipment with support rings can be variably arranged so that, according to the pressure in the hollow body, a correspondingly higher number of support rings is used at higher pressure.

In a further advantageous embodiment of the invention the coefficient of thermal expansion of the segments is dimensioned so that it compensates the coefficient of thermal expansion of the hollow body of elastic material.

In a further embodiment of the invention at least one separate slidably insertable locking member is provided between hollow body and stator casing to prevent a rotational displacement. This can, for example, consist of a rod or a profile which is advantageously inserted in the longitudinal direction and represents a positive contact between casing and hollow body.

According to the invention, a hollow body of a stator for an eccentric spiral pump is made of an elastic material and has a helical cavity for accommodating a rotor, and an outside having a polygon-shaped cross-section. The polygon-shaped outside enters into force-locked engagement with the polygon-shaped inside of the casing. In this case, it is unimportant whether the individual part surfaces of the polygon are made to be of the same or a different size. It is important that the hollow body has a plurality of surfaces extending in the longitudinal direction.

List of Reference Numerals

1 Hollow body made of elastic material
2 Helical cavity
3 Rotor
4, 4*a*, 4*b*, 4*c* Segments
5 First connecting element
6 Second connecting element
7 Outside of hollow body
8 Segment type 4
9 Segment type 3
10 Segment type 2
11 Segment type 1
12*a*, 12*b*, 12*c* Support rings
13*a*, 13*b* End rings
14 Contact surface
15 Hole
16 Retaining teeth
17 Connecting element
18 Bolt

The invention claimed is:

1. Stator for an eccentric spiral pump, comprising:

a hollow body of an elastic material, the hollow body extending in a longitudinal direction and having a helical cavity formed therein for receiving a rotor; and a casing provided on an outside of the hollow body, the casing comprising a plurality of segments exceeding three and having a length extending in the longitudinal direction, adjacent segments being interconnected at angles to each other along longitudinal sides, so that the segments enclose the hollow body of variable outer circumference;

wherein adjacent segments are linked to each another at variable angles depending on the number of segments being linked to form a tension-loadable positive connection, and wherein the lengths of individual segments are shorter than a length of the hollow body; and at least two rows of segments are disposed to be one behind another along the longitudinal direction of the hollow body.

2. Stator according to claim 1 ,wherein surfaces of individual segments are substantially planar, so that the casing enclosing the hollow body is of approximately polygonal cross-section; and the outside of the hollow body has an approximately polygonal cross-section and a same number of surfaces as a number of segments disposed along the circumference of the hollow body, so that a positive or force-locked connection is established between the hollow body of elastic material and the interconnected segments.

3. Stator according to claim 1, wherein adjacent longitudinal sides of at least two segments are constructed so that the at least two segments intermesh and form a tensile-loadable positive or force-locked connection.

4. Stator according to claim 1, wherein longitudinal sides of a plurality of segments are constructed as a tongue-and-groove arrangement along the longitudinal direction so that they can be pushed into engagement in the longitudinal direction.

5. Stator according to claim 1 wherein a plurality of segments have drill-holes (15) running along the longitudinal direction.

6. Stator according to claim 1 wherein a plurality of segments are interconnected along the longitudinal direction by fixing elements.

7. Stator according to claim 1, wherein the longitudinal sides of a plurality of segments have circular, intermeshing profiles.

8. Stator according to claim 1, wherein the longitudinal sides of a plurality of segments have angular intermeshing profiles.

9. Stator according to claim 1 wherein at least two successive segments disposed along the longitudinal direction are laterally offset from each other by a width of one segment along the circumferential direction.

10. Stator according to claim 9, wherein at least two segments in a form of chain members have integrated connecting elements connecting the chain members to each other.

11. Stator according to claim 1, wherein at least two segments are interconnected in a form of chain members.

12. Stator according to claim 1, wherein means for limiting an angular range of movement of the segments with respect to each other are provided.

13. Stator according to claim 1 ,wherein the segments are provided with an additional force-locked connection to each other.

14. Stator according to claim 1, wherein an additional force-locked connection is provided between the segments and the hollow body.

15. Stator according to claim 1, wherein at least one segment has a surface with particularly high roughness or retaining 15 teeth on a side facing the hollow body.

16. Stator according to claim 1, wherein at least one segment has at least one additional contact surface for supporting the hollow body.

17. Stator according to claim 1, wherein the hollow body overlaps end faces of the segments.

18. Stator according to claim 1, wherein the casing comprises segments consisting of a material having a substantially higher stiffness than that of the hollow body.

19. Stator according to claim 1, wherein the casing comprises segments of elastic material.

20. Stator according to claim 1, wherein at least one tensioning means is provided additionally to reduce a diameter of the casing consisting of individual segments.

21. Stator according to claim 1, wherein support rings are provided additionally for supporting the segments from outside.

22. Stator according to claim 1, wherein the segments have a coefficient of thermal expansion matched to that of the hollow body of elastic material to allow for temperature changes.

23. Stator according to claim 1, wherein at least one separate locking member is provided to be slidably inserted between the hollow body and the stator casing to prevent a rotational displacement.

24. Stator according to claim 1, wherein longitudinal sides of a plurality of segments are constructed as a bolted arrangement along the longitudinal direction so that they can be pushed into engagement in the longitudinal direction.

* * * * *